US005757328A

United States Patent [19]

Saitoh

[11] Patent Number: 5,757,328

[45] Date of Patent: May 26, 1998

[54] WINDOWPANE ANTENNA FOR VEHICLES

[75] Inventor: Masatoshi Saitoh, Machida, Japan

[73] Assignee: Harada Industry Co., Ltd., Tokyo, Japan

[21] Appl. No.: 720,305

[22] Filed: Sep. 27, 1996

[30] Foreign Application Priority Data

Sep. 27, 1995 [JP] Japan ..... 7-249597

[51] Int. Cl.[6] ..... H01Q 1/32

[52] U.S. Cl. ..... 343/713; 343/725; 343/742

[58] Field of Search ..... 343/711, 712, 343/713, 725, 722, 741, 742, 743, 744, 802, 803, 804

[56] References Cited

U.S. PATENT DOCUMENTS

| | | | |
|---|---|---|---|
| 2,923,813 | 2/1960 | Davis | 343/712 |
| 2,972,145 | 2/1961 | Watts | 343/742 |
| 3,007,164 | 10/1961 | Davis | 343/712 |
| 4,433,336 | 2/1984 | Carr | 343/742 |
| 4,804,968 | 2/1989 | Ohe et al. . | |
| 4,987,423 | 1/1991 | Bouko et al. | 343/742 |
| 5,285,210 | 2/1994 | Sato et al. . | |
| 5,402,134 | 3/1995 | Miller et al. . | |
| 5,442,368 | 8/1995 | Harada et al. | 343/742 |

FOREIGN PATENT DOCUMENTS

| | | |
|---|---|---|
| 0584882 | 3/1994 | European Pat. Off. . |
| 6152216 | 5/1994 | Japan . |

*Primary Examiner*—Donald T. Hajec
*Assistant Examiner*—Tho Phan
*Attorney, Agent, or Firm*—John P. White; Cooper & Dunham LLP

[57] ABSTRACT

A vehicle windowpane antenna comprises a first windowpane antenna element and a second windowpane antenna element which cooperate to perform diversity receiving of a VHF band signal and a UHF band signal. Each of the first and second windowpane antenna elements includes a VHF double-loop antenna pattern portion including two loops consisting of two conductive wires with connecting ends, the two loops being attached to a windowpane with their connecting ends connected with each other, a feeder portion provided at the connecting ends of the VHF double-loop antenna pattern portion, and connected to a feeder line, capacitive coupling portions each including a pair of conductors respectively extending from intermediate portions of the loops of the VHF double-loop antenna pattern portion such that the conductors are opposed to each other and can form a short circuit within the VHF double-loop antenna pattern portion in a high frequency state, and a device for setting the electrostatic capacitance of each of the capacitive coupling portions, such that the capacitive coupling portions are not conductive when a VHF band signal is received, and conductive in a high frequency state when a UHF band signal is received.

5 Claims, 3 Drawing Sheets

WINDOWPANE ANTENNA FOR VEHICLES

BACKGROUND OF THE INVENTION

1. Field of the Invention

This invention relates to a vehicle windowpane antenna to be attached, for example, to the rear window of an automobile, etc., and equipped with double-loop antenna pattern portion which can receive a VHF (Very-High Frequency) band signal of about 30–300 MHz and a UHF (Ultra-High Frequency) band signal of about 300 MHz–3 GHz.

2. Description of the Related Art

A conventional vehicle windowpane antenna of this type comprises a VHF double-loop antenna pattern unit capable of receiving a VHF band signal, a UHF double-loop antenna pattern unit capable of receiving a UHF band signal, and feeder lines connected to the pattern units, respectively. These pattern units are formed of a thin and slim conductive wire and arranged parallel to each other, for example, on the rear window of a vehicle.

FIG. 5 shows an example of the conventional windowpane antenna. As is shown in FIG. 5, a VHF double-loop antenna pattern unit 30 and a UHF double-loop antenna pattern unit 40, which are made of conductive wires, are arranged in the vertical direction on a windowpane 2 of a vehicle.

The VHF double-loop antenna pattern unit 30 has a pair of conductive wire loops arranged symmetrical in the horizontal direction, i.e. a first rectangular loop 31 and a second rectangular loop 32. A feeder portion 33 is provided at a junction between the first and second loops 31 and 32.

The UHF double-loop antenna pattern unit 40 has a pair of conductive wire loops arranged symmetrical in the horizontal direction, i.e. a first rectangular loop 41 and a second rectangular loop 42. A feeder portion 43 is provided at a junction between the first and second loops 41 and 42.

Feeder lines (not shown) are connected to the feeder portions 33 and 43, respectively.

Since in the above-described conventional vehicle windowpane antenna, the VHF double-loop antenna pattern unit 30 and the UHF double-loop antenna pattern unit 40 are provided independently, these pattern units disadvantageously occupy a relatively large area on the windowpane. Further, the two feeder portions must be connected to the feeder lines, respectively, which makes the structure of each junction complicated and accordingly requires much labor in connecting operations.

SUMMARY OF THE INVENTION

It is an object of the invention to provide a vehicle windowpane antenna consisting of a single body capable of receiving both a VHF band signal and a UHF band signal.

It is another object of the invention to provide a vehicle windowpane antenna capable of diversity signal receiving, which comprises windowpane antenna elements each capable of receiving both a VHF band signal and a UHF band signal.

To achieve the above objects, the vehicle window pane antenna according to the present invention has the following constructions.

(1) According to an aspect of the invention, there is provided a vehicle windowpane antenna comprising:

a VHF double-loop antenna pattern portion including two loops consisting of two conductive wires with connecting ends, the two loops being attached to a windowpane with their connecting ends connected with each other;

a feeder portion provided at the connecting ends of the VHF double-loop antenna pattern portion, and connected to a feeder line;

capacitive coupling portions each including a pair of conductors respectively extending from intermediate portions of the loops of the VHF double-loop antenna pattern portion such that the conductors are opposed to each other and can form a short circuit within the VHF double-loop antenna pattern portion in a high frequency state; and means for setting the electrostatic capacitance of each of the capacitive coupling portions, such that the capacitive coupling portions are not conductive when a VHF band signal is received, and conductive in a high frequency state when a UHF band signal is received.

Preferably, the conductors of each of the capacitive coupling portions comprise a pair of conductive wires opposed to each other over a predetermined length with a predetermined gap interposed therebetween.

More preferably, the loops formed of the respective conductive wires are attached to a lower area of the windowpane along a window frame.

(2) According to another aspect of the invention, there is provided a vehicle windowpane antenna comprising a first windowpane antenna element and a second windowpane antenna element which cooperate to perform diversity receiving of a VHF band signal and a UHF band signal, each of the first and second windowpane antenna elements including:

a VHF double-loop antenna pattern portion including two loops consisting of two conductive wires with connecting ends, the two loops being attached to a windowpane with their connecting ends connected with each other;

a feeder portion provided at the connecting ends of the VHF double-loop antenna pattern portion, and connected to a feeder line;

capacitive coupling portions each including a pair of conductors respectively extending from intermediate portions of the loops of the VHF double-loop antenna pattern portion such that the conductors are opposed to each other and can form a short circuit within the VHF double-loop antenna pattern portion in a high frequency state; and means for setting the electrostatic capacitance of each of the capacitive coupling portions, such that the capacitive coupling portions are not conductive when a VHF band signal is received, and conductive in a high frequency state when a UHF band signal is received.

Preferably, the first and second windowpane antenna elements are attached to lower areas of the windowpane, separated from each other in the horizontal direction, and the loops of the first and second antenna elements extend in the lower areas of the windowpane along a window frame.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENT

(Embodiment)

Figure 1:
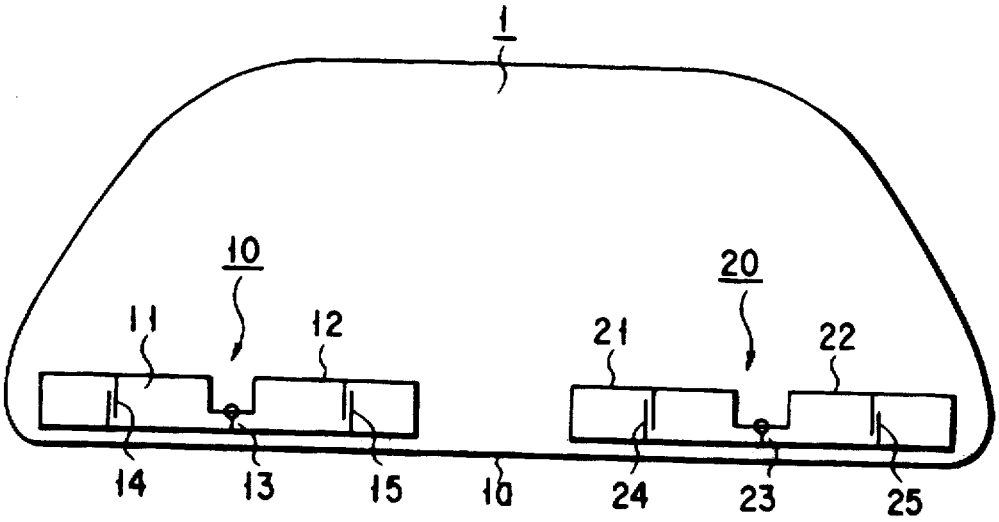
FIG. 1 is a front view, showing a diversity windowpane antenna for vehicles, according to an embodiment of the invention, mounted on the rear window of a vehicle.

As is shown in FIG. 1, a first windowpane antenna element 10 and a second windowpane antenna element 20 are provided on a lower portion of the rear window of a vehicle (e.g. an automobile), and arranged symmetrical to each other in the horizontal direction with a predetermined distance interposed therebetween. Each of the windowpane antenna elements 10 and 20 can perform diversity receiving of a VHF band signal and a UHF band signal. However, a diversity reception circuit is not shown in the figures.

The first windowpane antenna element 10 has a first loop 11, a second loop 12, a feeder portion 13 and capacitive coupling portions 14 and 15. Similarly, the first windowpane antenna element 20 has a first loop 21, a second loop 22, a feeder portion 23 and capacitive coupling portions 24 and 25.

Since the first and second windowpane antenna elements 10 and 20 have, thus, the same structure, only the first windowpane antenna element 10 will be described in more detail.

Figure 2:
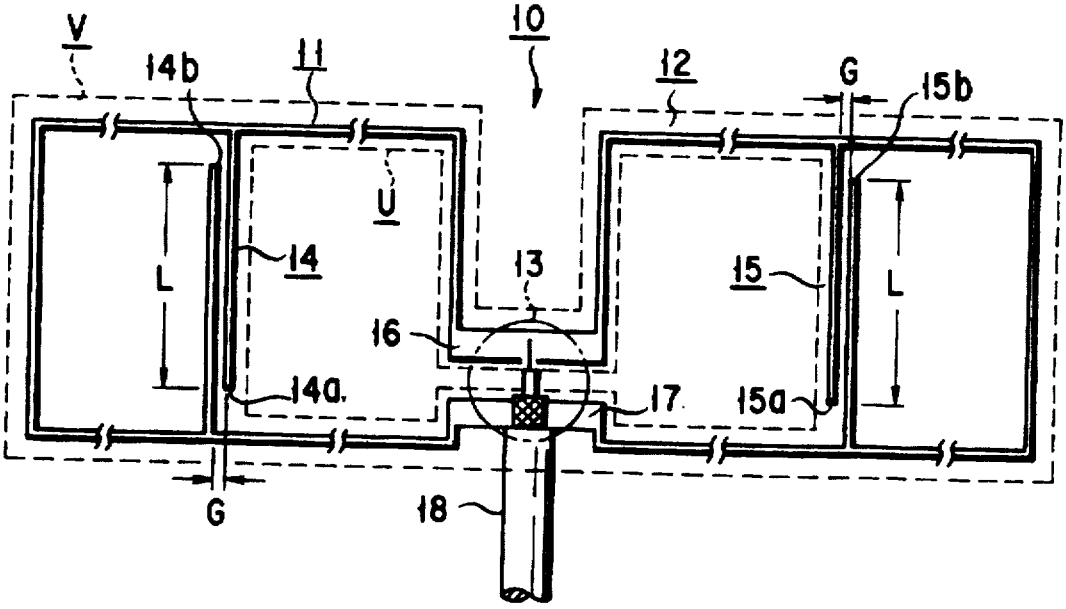
FIG. 2 is a view, showing the double-loop antenna pattern portion of a first windowpane antenna element incorporated in the diversity windowpane antenna for vehicles of FIG. 1.

As is shown in FIG. 2, the first windowpane antenna element 10 includes a VHF double-loop antenna pattern portion V and a UHF double-loop antenna pattern portion U.

The VHF double-loop antenna pattern portion V is constituted by the first loop 11, the second loop 12 and connecting conductive members 16 and 17 which connect the first loop with the second loop. The first loop 11 is formed of a rectangular conductive wire, which has a width of several millimeters and is made of a thin film. The second loop 12 is formed in the same manner as the first loop, and arranged symmetrical to the first loop 11 in the horizontal direction. The connecting conductive members 16 and 17 have a width greater than that of the first and second loops 11 and 12. The feeder portion 13 is constituted by center portions of the connecting conductive members 16 and 17. A feeder line 18 is connected to the feeder portion 13.

The capacitive coupling portion 14 is provided at a certain portion of the first loop 11 of the VHF double-loop antenna pattern portion V. More specifically, the capacitive coupling portion 14 consists of a pair of conductive wire members **14*a* and 14*b* (made of the same material as the first loop 11 and have the same width and thickness as the loop 11), which inwardly extend from respective intermediate portions of the opposite long sides of the rectangular first loop 11 such that they are opposed to each other over a length L, with a predetermined small gap G interposed therebetween. By virtue of the thus-constructed capacitive coupling portion 14, high frequency short-circuiting can occur in the first loop 11. The electrostatic capacitance of the coupling portion 14 is set such that high frequency short-circuiting will not occur when the antenna receives a VHF band signal, and will occur when it receives a UHF band signal, thereby closing the circuit of the UHF double-loop antenna pattern portion U. The electrostatic capacitance can easily be set to a desired value by adjusting the gap G and the length L concerning the conductive wire members 14*a* and 14*b*** at the time of manufacturing the antenna.

The capacitive coupling portion 15 is provided at a certain portion of the second loop 12 of the VHF double-loop antenna pattern portion V. As in the case of the coupling portion 14, the coupling portion 15 consists of a pair of conductive wire members **15*a* and 15*b* (made of the same material as the second loop 12 and have the same width and thickness as the loop 12), which inwardly extend from respective intermediate portions of the opposite long sides of the rectangular second loop 12 such that they are opposed to each other over the same length L, with the same gap G interposed therebetween. By virtue of the thus-constructed capacitive coupling portion 15, high frequency short-circuiting can occur in the second loop 12. The electrostatic capacitance of the coupling portion 15 is set such that high frequency short-circuiting will not occur when the antenna receives a VHF band signal, and will occur when it receives a UHF band signal, thereby closing the circuit of the UHF double-loop antenna pattern portion U. The capacitance of the coupling portion 15 can easily be set to a desired value as in the case of the coupling portion 14**.

Thus, at the time of receiving a VHF band signal, the overall VHF double-loop antenna pattern portion V serves as a VHF antenna element. On the other hand, at the time of receiving a VHF band signal, the capacitive coupling portions 14 and 15 become conductive in a high frequency state, and the UHF double-loop antenna pattern portion U constituted by part of the VHF double-loop antenna pattern portion V serves as a UHF antenna element.

(Modifications)

The vehicle windowpane antenna according to the embodiment can be modified as follows:

i) Part or all of the capacitive coupling portion 14, 15 and capacitive coupling portion 24, 25 are formed of a conductive body with a shape (e.g. a T-shaped body) other than a linear shape.

ii) The first and second loops 11 and 12 of the VHF double-loop antenna pattern portion V have a shape (e.g. an oval shape) other than the rectangular shape.

iii) The antenna is attached to a windowpane of a vehicle other than an automobile.

(Experimental Results)

Figure 3:
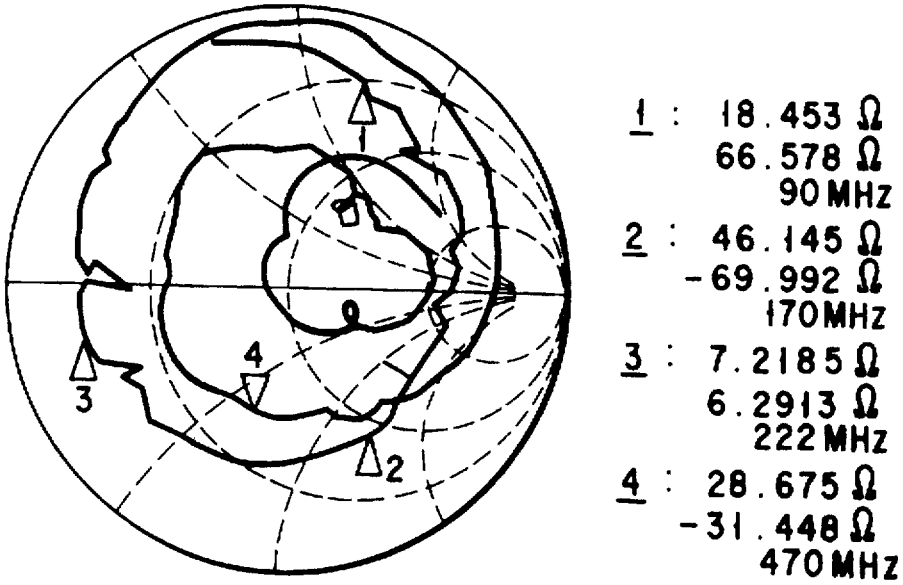
FIG. 3 is a Smith chart, showing the impedance characteristic of an experimental sample of the embodiment of the invention.

FIG. 3 is a Smith chart, showing the impedance characteristic of an experimental sample of the embodiment of the invention.

Figure 4:
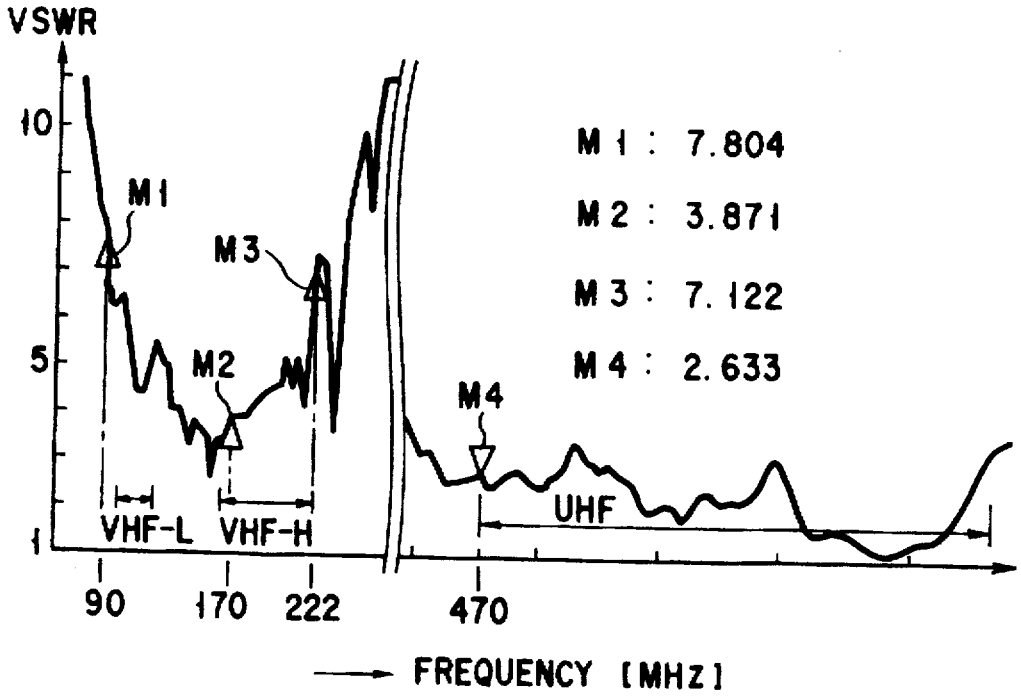
FIG. 4 is a graph, showing the VSWR characteristic of the experimental sample of FIG. 3.
Figure 5:
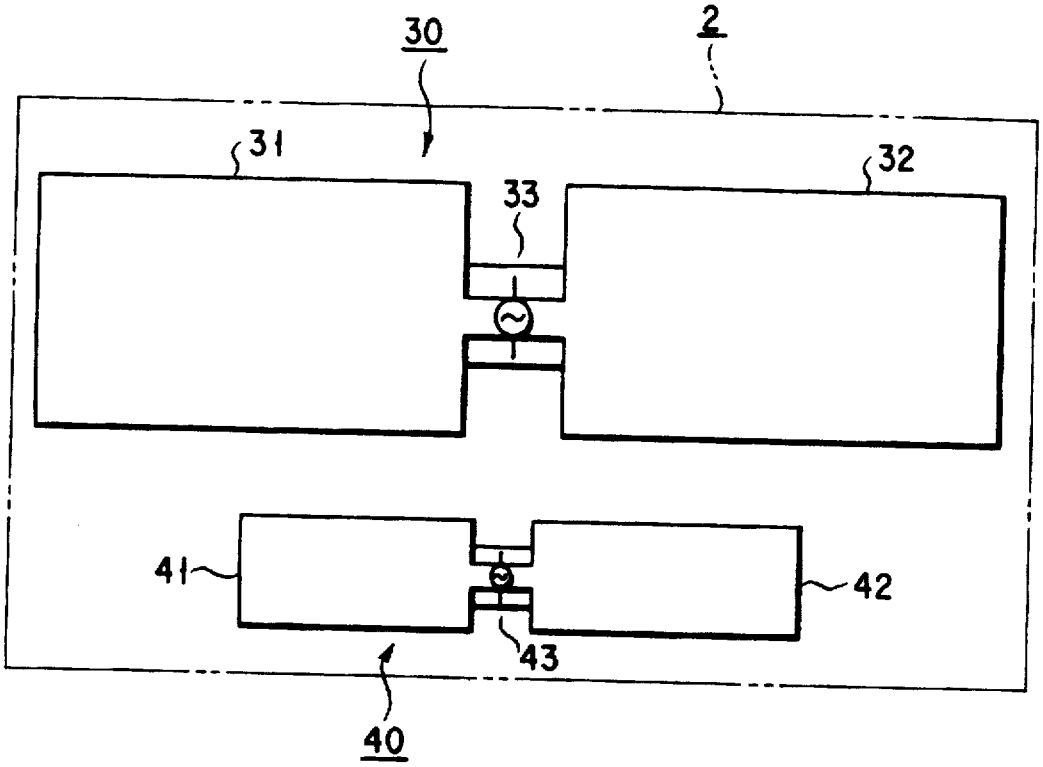
FIG. 5 (PRIOR ART)
FIG. 5 is a view, showing a conventional vehicle windowpane antenna.

FIG. 4 is a graph, showing the VSWR characteristic of the experimental sample of the embodiment of the invention.

As is evident from FIGS. 3 and 4, the experimental sample has, in the VHF-L (low) band, the VHF-H (high) band and the UHF band, an impedance characteristic and a VSWR characteristic with which the sample can be put to practice.

(Merits of the Embodiment and Modifications)

The vehicle windowpane antennas according to the embodiment and the modifications have structures and advantages as described below.

[1] The vehicle windowpane antenna according to the embodiment is characterized by comprising:

a VHF double-loop antenna pattern portion V including two loops 11 and 12 consisting of two conductive wires with connecting ends, the two loops 11 and 12 being attached to a windowpane 1 with their connecting ends connected with each other;

a feeder portion 13 provided at the connecting ends of the VHF double-loop antenna pattern portion V, and connected to a feeder line 18;

capacitive coupling portions 14 and 15 each including a pair of conductors respectively extending from intermediate portions of the loops 11 and 12 of the VHF double-loop antenna pattern portion V such that the conductors are opposed to each other and can form a short circuit within the VHF double-loop antenna pattern portion in a high frequency state; and means for setting the electrostatic capacitance of each of the capacitive coupling portions 14 and 15, such that the capacitive coupling portions are not conductive when a VHF band signal is received, and conductive in a high frequency state when a UHF band signal is received.

In the vehicle windowpane antenna constructed as above, when the antenna receives a VHF band signal, the overall VHF double-loop antenna pattern portion V serves as a VHF antenna element, while when it receives a UHF band signal, the capacitive coupling portions 14 and 15 become conductive in a high frequency state, and the UHF double-loop antenna pattern portion U constituted by part of the VHF double-loop antenna pattern portion V serves as a UHF antenna element. Thus, the windowpane antenna can receive both a VHF band signal and a UHF band signal in good conditions, although it is formed of a single double-loop antenna pattern portion. Accordingly, the antenna of the embodiment occupies a relatively small area of a windowpane, as compared with the conventional antenna which consists of separated VHF and UHF double-loop antenna pattern units. Moreover, since the embodiment requires only a single feeder portion 13 and a single feeder line 18, the antenna has a simple connection structure, and the connecting operations of the feeder line 18 are simplified.

[2] The vehicle windowpane antenna according to the antenna described in item [1] is characterized in that the conductors of each of the capacitive coupling portions 14 and 15 consist of a pair of conductive wires 14*a* and 14*b* (15*a* and 15*b*) opposed to each other over a predetermined length L with a predetermined gap G interposed therebetween.

This antenna has the same advantage as stated in item [1], and also the advantage that the electrostatic capacitance between the conductive wires 14*a* and 14*b* (15*a* and 15*b*) can be easily set to a desired value by adjusting the gap G and the length L concerning the conductive wire members 14*a* and 14*b* (15*a* and 15*b*) at the time of manufacturing the antenna.

[3] The vehicle windowpane antenna according to the antenna described in item [1] is characterized in that the loops 11 and 12 formed of the respective conductive wires are attached to a lower area of the windowpane 1 along a window frame 1*a*.

This antenna has the same advantage as stated in item [1], also the advantage that the dead space of the windowpane 1 can be effectively used, and the advantage that the feeder line 18 can be connected easily since the double-loop antenna pattern portions V and U are located near the window frame 1*a* of the windowpane 1.

[4] The vehicle windowpane antenna according to the embodiment is characterized by comprising: a first windowpane antenna element 10 and a second windowpane antenna element 20 which cooperate to perform diversity receiving of a VHF band signal and a UHF band signal, each of the first and second windowpane antenna elements 10 and 20 constructed in the same manner as the antenna described in item [1].

This antenna has the same advantage as stated in item [1], also the advantage that it can avoid bad influence due to fading and can perform good signal receiving.

[5] The vehicle windowpane antenna according to the antenna described in item [4] is characterized in that the first and second windowpane antenna elements are attached to lower areas of the windowpane 1, separated from each other in the horizontal direction, and the loops 11, 12 of the first antenna element 10 and the loops 21, 22 of the second antenna element 20 extend in the lower areas of the windowpane 1 along a window frame 1*a*.

This antenna has the same advantage as stated in item [4], also the advantage that the dead space of the windowpane 1 can be effectively used, the advantage that the feeder line 18 can be connected easily since the double-loop antenna pattern portions V and U are located near the window frame 1*a* of the windowpane 1, and the advantage that circuit connection for diversity signal receiving can be performed easily.

What is claimed is:

1. A vehicle windowpane antenna comprising:

a VHF double-loop antenna pattern portion including two loops consisting of two conductive wires with connecting ends, the two loops being attached to a windowpane with their connecting ends connected with each other;

a feeder portion provided at the connecting ends of the VHF double-loop antenna pattern portion, and connected to a feeder line;

capacitive coupling portions each including a pair of conductors respectively extending from intermediate portions of the loops of the VHF double-loop antenna pattern portion such that the conductors are opposed to each other and can form a short circuit within the VHF double-loop antenna pattern portion in a high frequency state; and means for setting the electrostatic capacitance of each of the capacitive coupling portions, such that the capacitive coupling portions are not conductive when a VHF band signal is received, and conductive in a high frequency state when a UHF band signal is received.

2. The antenna according to claim 1, wherein the conductors of each of the capacitive coupling portions comprise a pair of conductive wires opposed to each other over a predetermined length with a predetermined gap interposed therebetween.

3. The antenna according to claim 1, wherein the loops formed of the respective conductive wires are attached to a lower area of the windowpane along a window frame.

4. A vehicle windowpane antenna comprising a first windowpane antenna element and a second windowpane antenna element which cooperate to perform diversity receiving of a VHF band signal and a UHF band signal, each of the first and second windowpane antenna elements including:

a VHF double-loop antenna pattern portion including two loops consisting of two conductive wires with connecting ends, the two loops being attached to a windowpane with their connecting ends connected with each other;

a feeder portion provided at the connecting ends of the VHF double-loop antenna pattern portion, and connected to a feeder line;

capacitive coupling portions each including a pair of conductors respectively extending from intermediate portions of the loops of the VHF double-loop antenna pattern portion such that the conductors are opposed to each other and can form a short circuit within the VHF double-loop antenna pattern portion in a high frequency state; and means for setting the electrostatic capacitance of each of the capacitive coupling portions, such that the capacitive coupling portions are not conductive when a VHF band signal is received, and conductive in a high frequency state when a UHF band signal is received.

5. The antenna according to claim 4, wherein the first and second windowpane antenna elements are attached to lower areas of the windowpane, separated from each other in the horizontal direction, and the loops of the first and second antenna elements extend in the lower areas of the windowpane along a window frame.

* * * * *